US005113111A

United States Patent [19]

Fairbanks

[11] Patent Number: 5,113,111

[45] Date of Patent: May 12, 1992

[54] TENSIONED SHAWOD MASK/FRAME ASSEMBLY FOR A COLOR PICTURE TUBE

[75] Inventor: David W. Fairbanks, Monmouth Junction, N.J.

[73] Assignee: RCA Thomson Licensing Corporation, Princeton, N.J.

[21] Appl. No.: 743,624

[22] Filed: Aug. 12, 1991

[51] Int. Cl.[5] ..... H01J 29/80; H01J 29/81

[52] U.S. Cl. ..... 313/404; 313/402; 313/407

[58] Field of Search ..... 313/402, 404, 407, 408, 313/269

[56] References Cited

U.S. PATENT DOCUMENTS 4,798,992 1/1989 Ichigaya et al. ..... 313/407
5,003,218 3/1991 Gijrath et al. ..... 313/407

*Primary Examiner*—Palmer C. DeMeo
*Assistant Examiner*—Nimeshkumar D. Patel
*Attorney, Agent, or Firm*—J. S. Tripoli; D. H. Irlbeck; L. L. Hallacher

[57] ABSTRACT

A tensioned shadow mask/frame assembly includes horizontal top and bottom members and vertical side members. One of the horizontal members is permanently affixed to the side members and the other horizontal member is slideably supported on the side members. The horizontal members are biased apart to put tension on a shadow mask which is stretched across and permanently affixed thereto. The cross sectional configuration of the horizontal members is an acute angle having a long side and a short side joined at a rounded apex to maximize the stiffness of the members.

15 Claims, 4 Drawing Sheets

TENSIONED SHAWOD MASK/FRAME ASSEMBLY FOR A COLOR PICTURE TUBE

BACKGROUND

This invention relates generally to color television picture tubes and particularly to a tensioned shadow mask/frame assembly for such tubes.

FIG. 1 shows a cross section of a color picture tube (kinescope) in which the invention can be utilized. The tube 10 includes a funnel portion 11 the wide end of which is enclosed by a faceplate panel 12 and the narrow opening of which is enclosed by a neck portion 13. A phosphor screen 14 is arranged on the inside surface of the faceplate panel 12. The screen 14 is composed of triads of phosphor materials which individually emit the three primary colors of light when impacted by electrons. An electron gun 16 is mounted in the neck 13 and provides three electron beams which are scanned across the screen 14 to energize the phosphors and produce the desired display. Each of the three beams impacts a different color emitting phosphor so that the full range of colors is produced on the screen 14. A shadow mask/frame assembly 17 is supported by studs 18 a preselected distance from the phosphor screen 14. A shadow mask 19 is part of the mask/frame assembly 17 and includes a large number of apertures through which the electron beams pass to direct the various beams to phosphors of the proper light emitting colors.

One type of shadow mask is a tensioned shadow mask. A tensioned shadow mask is permanently attached to the upper and lower horizontal members of a support frame. The horizontal members run parallel to the horizontal (X) axis of the kinescope. The horizontal frame members are held together by side members which extend parallel to the vertical (Y) axis of the kinescope. The mask contains a large number of narrow slits which extend parallel to the vertical axis. While the shadow mask 19 is being permanently attached (for example, by welding) to the horizontal members of the support frame 20, the horizontal members are pressed inwardly toward one another to deflect them. Accordingly, the shadow mask is under tension as the horizontal members attempt to return to their undeflected positions when the pressure is relieved upon the completion of the attachment. The tensioning of the shadow mask is necessary to insure that the spacing between the screen 14 and the shadow mask 19 remains constant along the longitudinal (Z) axis of the tube 10. Despite the pretensioning of the shadow mask during its attachment to the support frame assembly, problems frequently arise with tensioned shadow masks. For example, when the faceplate 12 is frit sealed to the funnel 11 along the frit seal line 15, the tube is subjected to high temperatures, such as 600° C. The shadow mask/frame assembly therefore expands and because high temperature and high tension (e.g. 20,000 psi) cause the shadow mask material to creep (become permanently longer), when the frame assembly returns to normal temperature the mask material is looser than it originally was. This results in a permanent change in the tension of the shadow mask and thus has an adverse impact on the quality of the display produced on the screen 14. Another difficulty frequently arises each time the tube is turned on. When the tube 10 is turned on, the frame and shadow mask are cold. The frame gradually heats up during the normal tube operation. However, the shadow mask has lower mass than the frame and therefore heats up and expands faster than the frame, this causes the tension in the shadow mask to temporarily decrease. In many instances the picture quality therefore is not preferable during the warmup period. For these reasons there is a need for a tensioned shadow mask/frame assembly which continuously applies tension to the shadow mask during all manufacturing and operating stages. The present invention fulfills this long felt need.

SUMMARY

A tensioned shadow mask/frame assembly for a color picture tube includes a plurality of substantially parallel side members; and two substantially parallel horizontal members. One horizontal member is permanently fixed to the side members and the other horizontal member is slideably supported on the side members. A shadow mask is attached to the horizontal members and includes a plurality of slits extending substantially parallel to the side members and substantially the full distance between the horizontal members. The horizontal members are biased apart by a biasing member to place the shadow mask under tension.

DETAILED DESCRIPTION

Figure 1:
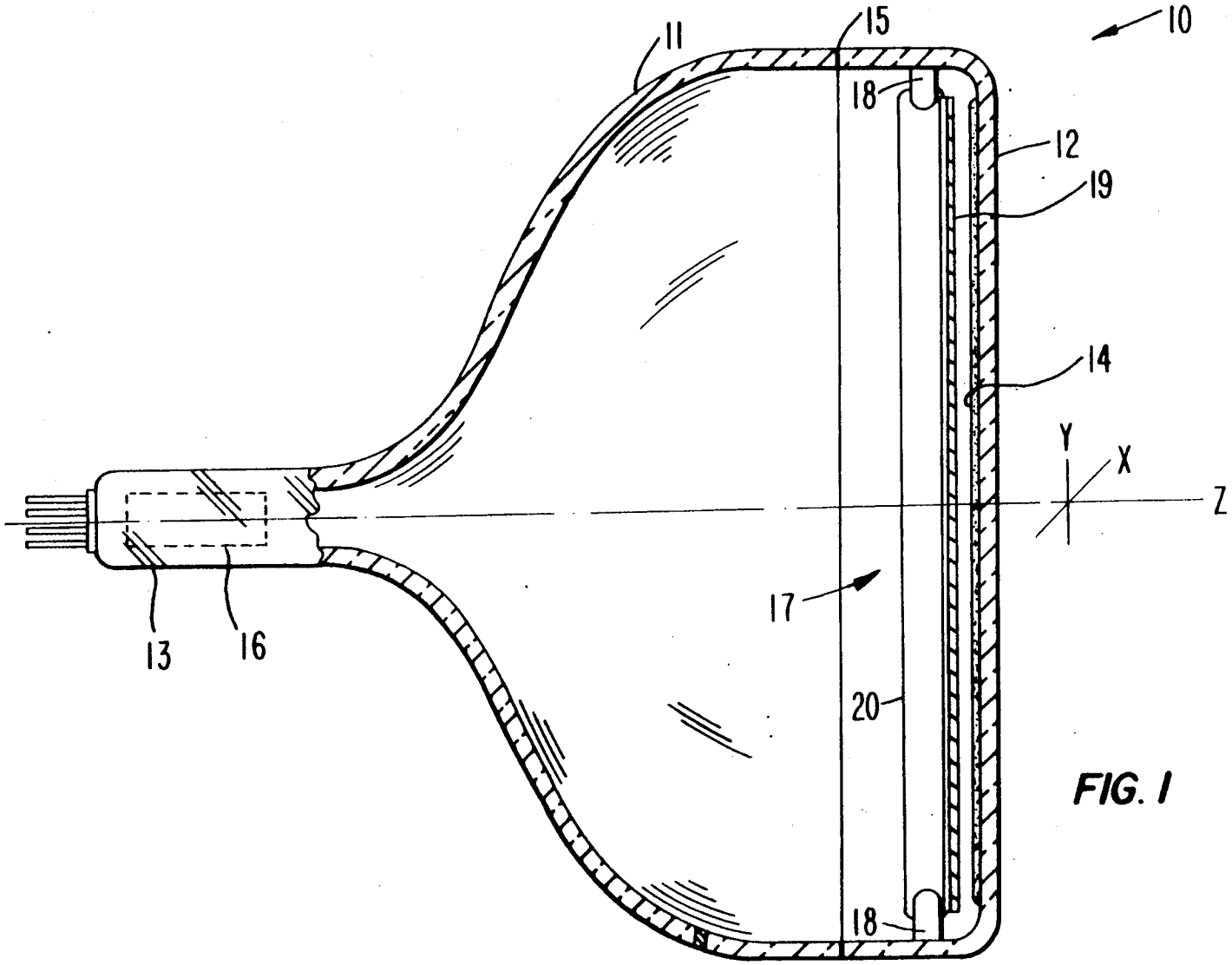
FIG. 1 is a cross section of a color picture tube including a shadow mask/frame assembly.
Figure 4:
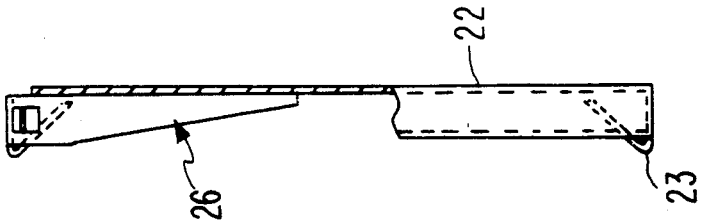
FIG. 4 is a side view, partially broken away, of the preferred embodiment of FIG. 2.
Figure 2:
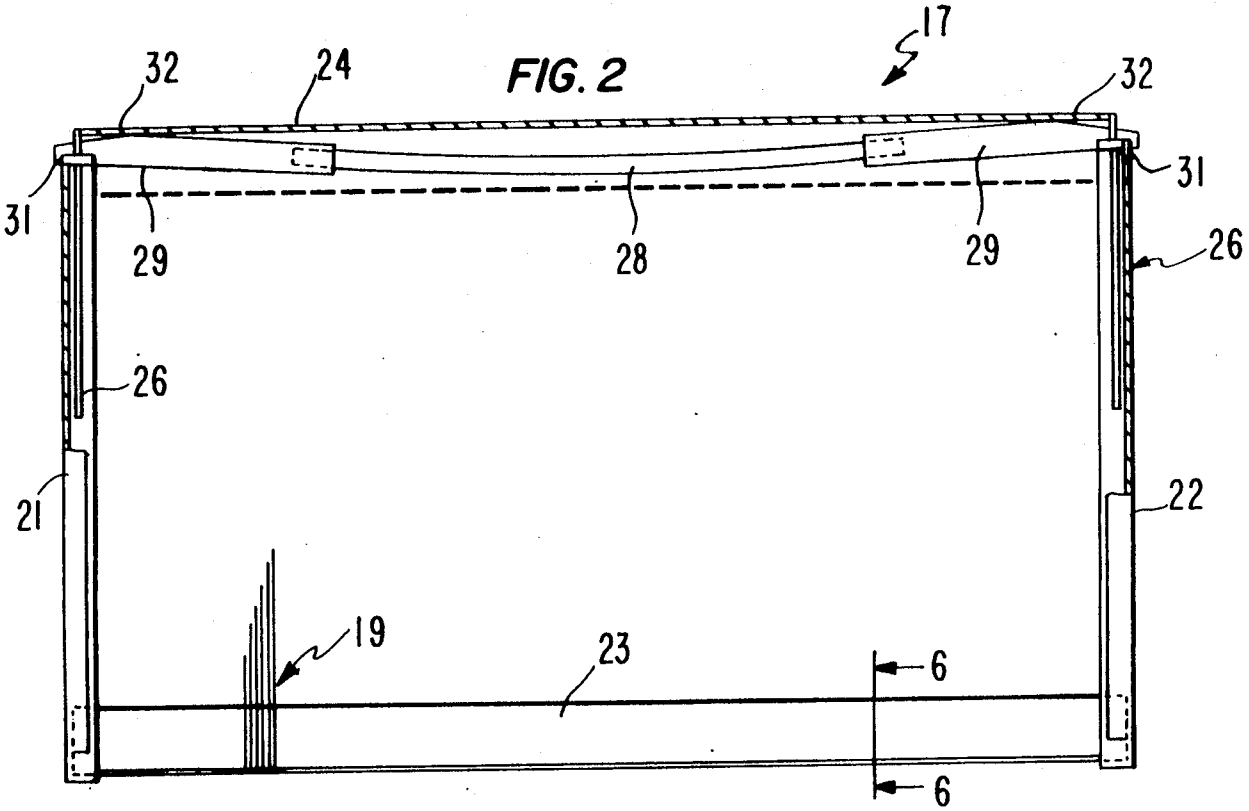
FIG. 2 is a front view of a preferred embodiment of the inventive tensioned shadow mask frame assembly.
Figure 3:
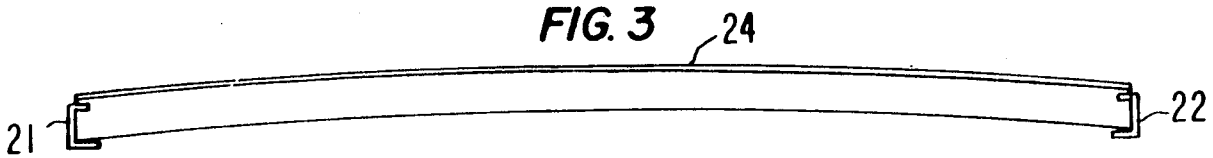
FIG. 3 is a top view of the preferred embodiment of FIG. 2.
Figure 5:
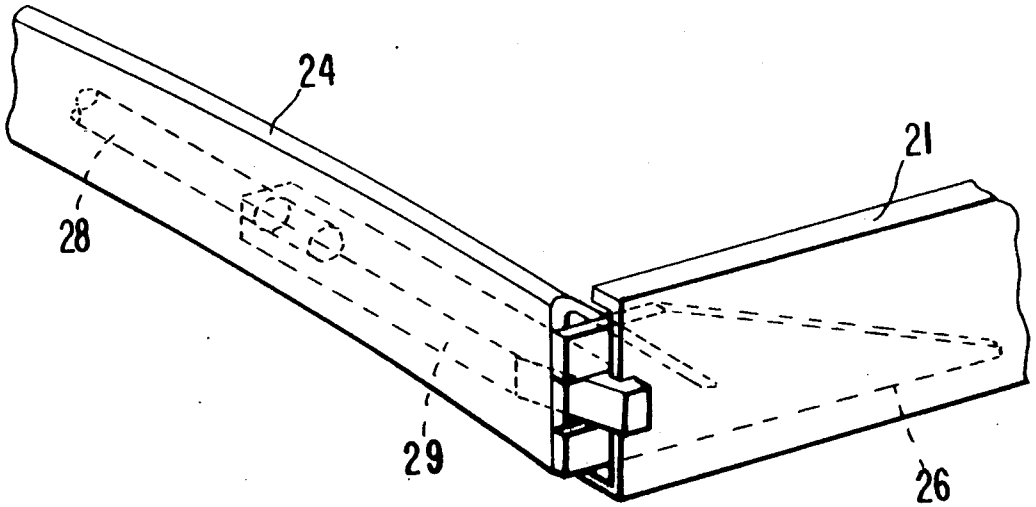
FIG. 5 is a detailed showing of the coupling of the slideable horizontal bar to the side channel.

In FIGS. 2, 3 and 4, the shadow mask/frame assembly 17 includes channel shaped side members 21 and 22. A horizontal member 23 is permanently fixed (for example welded) to one end of each of the side members 21 and 22. Another horizontal member 24 is slideably attached to the side members 21 and 22. Torque arms 26 are permanently attached to the ends of the slideable horizontal member 24. As best seen in FIGS. 4 and 5 torque arms 26 are blade shaped and are dimensioned substantially equally to the inside channel width of the side members 21 and 22. The torque arms 26 therefore are slideable within the channel members 21 and 22 and prevent rotation of the horizontal member 24. The shadow mask, represented by lines 19, is permanently affixed to the horizontal members 23 and 24 for the full length of the horizontal members. The shadow mask 19 is pretensioned and kept in tension in a manner fully described hereinafter.

A resilient rod 28 is equipped with ends 29, as best seen in FIGS. 2 and 5. The ends 29 pass through the torque arms 26 and include notches 31 which engage the tops of the side members 21 and 22. Pressure applying areas 32 of the ends 29 press against the inside of the slideable horizontal member 24. The spacing between the notches 31 exceeds the width of the shadow mask/frame assembly 17 so that the elongated resilient rod 28 is deflected and under tension. The rod 28 therefore serves as a spring means, and biases the slideable horizontal member 24 away from the horizontal member 23 to apply tension to the shadow mask 19. Because the ends 29 pass through the torque arms 26, the slideable horizontal member 24 is permanently held in place on the side members 21 and 22 by the ends 29. Also, because the width of the torque arms 26 is substantially equal to the width of the channels 21 and 22, the horizontal member 24 is prevented from rotating and relieving the tension in the shadow mask 19.

As shown in FIG. 3, the horizontal members 23 and 24 are curved. Typically the faceplate 12 of a color picture tube is curved along the horizontal axis. For such tube the radius of curvature of the horizontal members 23 and 24 is substantially equal to that of the screen 12 to maintain a constant spacing between the shadow mask 19 and the phosphor screen 14.

Figure 6:
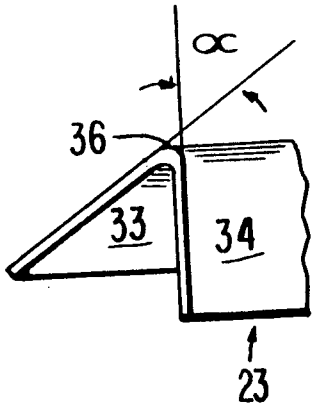
FIG. 6 is a cross section of the horizontal member taken along line 6—6 of FIG. 2.
Figure 7:
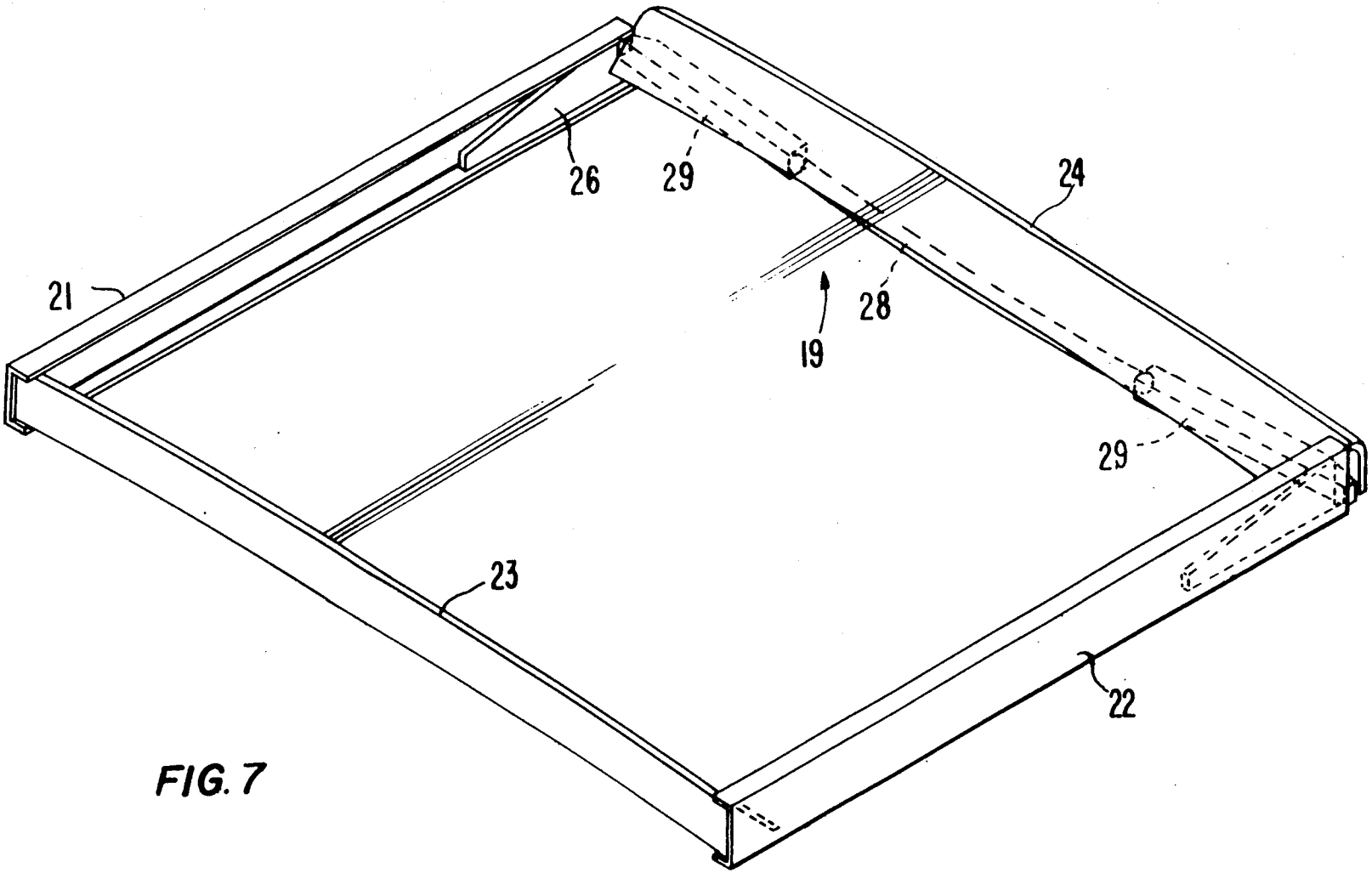
FIG. 7 is an isometric view of the preferred embodiment of FIG. 2.

In FIG. 6, the horizontal members 23 and 24 are substantially identical hollow members having an angular cross section including a long leg 33 and a short leg 34 joined at an acute angle $\alpha$. Preferably the angle $\alpha$ is in the order of 45°. The cross sectional configuration of horizontal members 23 and 24 is important because the selected configuration maximizes the stiffness of the members. Also, preferably the horizontal members 23 and 24 are formed from a single piece of material and accordingly the apex is somewhat flat and provides an excellent surface 36 for welding the shadow mask 19 to the horizontal members. The acute angle configuration of horizontal members 23 and 24 and the channel configuration of side members 21 and 22 are also advantageous because the long sides 33 of the horizontal members and the sides of the channel shaped members 21 and 22 serve as electron beam shields.

Although other materials can be used, the preferable material for the horizontal members 23 and 24 and the ends 29 is 4130 steel. Preferably the resilient rod 28 is made from A286 steel, a high temperature spring steel which maintains its resiliency up to 1,000° F. The side members 21 and 22 preferably are made from cold rolled steel and the shadow mask 27 can be made from either AK steel or invar.

The shadow mask 19 can be pretensioned by applying an inward pressure to the horizontal members 23 and 24 while the shadow mask is being welded to the horizontal members. The pressure deflects the members inwardly. Thus, when the pressure is relieved, after the attachment of the shadow mask is complete, the members tend to deflect outwardly to their original positions and apply a tensioning force to the shadow mask.

What is claimed is:

1. An improved tensioned shadow mask/frame assembly for a color picture tube having a horizontal axis, said picture tube having a screen and including means for supporting said shadow mask/frame assembly at a fixed distance from said screen, said shadow mask/-frame assembly comprising:

a plurality of substantially parallel side members;

first and second substantially parallel horizontal members, said first horizontal member being permanently fixed to said side members and said second horizontal member including means for slideably supporting said second horizontal member on said side members;

a shadow mask attached to said horizontal members and including a plurality of slits extending substantially parallel to said side members and substantially the full distance between said first and second horizontal members; and means for biasing said first and second horizontal members apart to place said shadow mask under tension.

2. The shadow mask/frame assembly of claim 1 wherein said means for biasing includes spring means.

3. The shadow mask/frame assembly of claim 2 wherein said spring means includes a resilient rod having ends supported by said side members and having pressure applying areas acting against said second horizontal member.

4. The shadow mask/frame assembly of claim 3 wherein said side members are channel shaped members having a preselected channel width, and wherein said means for slideably supporting include torque arms permanently affixed to the ends of said second horizontal member and dimensioned substantially equally to said channel width.

5. The shadow mask/frame assembly of claim 4 wherein said first and second horizontal members are hollow members having an angular cross section including a long leg and a short leg joined at an acute angle.

6. The shadow mask/frame assembly of claim 5 wherein said horizontal members are formed from a single piece of material.

7. The shadow mask/frame assembly of claim 6 wherein said acute angle is about 45°.

8. The shadow mask/frame assembly of claim 7 wherein said screen is curved along said horizontal axis and said first and second horizontal members are similarly curved along said horizontal axis.

9. The shadow mask/frame assembly of claim 1 wherein said first and second horizontal members are hollow members having an angular cross section including a long leg and a short leg joined at an acute angle.

10. The shadow mask/frame assembly of claim 9 wherein said horizontal members are formed from a single piece of material.

11. The shadow mask/frame assembly of claim 10 wherein said acute angle is about 45°.

12. The shadow mask/frame assembly of claim 11 wherein said screen is curved along said horizontal axis and said first and second horizontal members are similarly curved along said horizontal axis.

13. The shadow mask/frame assembly of claim 10 wherein said screen is curved along said horizontal axis and said first and second horizontal members are similarly curved along said horizontal axis.

14. The shadow mask/frame assembly of claim 1 wherein said side members are channel shaped members having a preselected channel width, and wherein said means for slideably supporting include torque arms permanently affixed to the ends of said second horizontal member and slideably arranged in said side members, and wherein said horizontal members are hollow members formed from a single piece of material and having an angular cross section including a long leg and a short leg joined at an acute angle.

15. The shadow mask/frame assembly of claim 14 wherein said acute angle is about 45°.

* * * * *